US009566487B2

(12) United States Patent
Feehan

(10) Patent No.: US 9,566,487 B2
(45) Date of Patent: Feb. 14, 2017

(54) GOLF CLUB OVERGRIP

(71) Applicant: John J. Feehan, Encinitas, CA (US)

(72) Inventor: John J. Feehan, Encinitas, CA (US)

( * ) Notice: Subject to any disclaimer, the term of this patent is extended or adjusted under 35 U.S.C. 154(b) by 0 days.

(21) Appl. No.: 14/728,078

(22) Filed: Jun. 2, 2015

(65) Prior Publication Data

US 2015/0352417 A1 Dec. 10, 2015

Related U.S. Application Data

(60) Provisional application No. 62/008,163, filed on Jun. 5, 2015.

(51) Int. Cl.
*A63B 53/14* (2015.01)
*A63B 53/00* (2015.01)

(52) U.S. Cl.
CPC ..... *A63B 53/14* (2013.01); *A63B 60/08* (2015.10); *A63B 60/14* (2015.10); *A63B 60/22* (2015.10); *A63B 53/007* (2013.01); *A63B 2209/14* (2013.01); *A63B 2210/50* (2013.01); *Y10T 29/49819* (2015.01); *Y10T 29/49828* (2015.01)

(58) Field of Classification Search
CPC ..... A63B 59/0029; A63B 60/62; A63B 60/22; A63B 60/14; A63B 53/14; A63B 60/08; A63B 53/007; A63B 2209/14; A63B 2210/50; Y10T 29/49828; Y10T 29/49819
See application file for complete search history.

(56) References Cited

U.S. PATENT DOCUMENTS

| | | | | |
|---|---|---|---|---|
| 4,662,415 | A * | 5/1987 | Proutt | A63B 53/14 150/160 |
| 4,869,511 | A * | 9/1989 | Spoonster, Sr. | A63B 69/3638 473/203 |
| 4,878,667 | A * | 11/1989 | Tosti | A63B 53/14 43/22 |
| 5,573,241 | A * | 11/1996 | Anderson | A63B 55/00 150/160 |
| 6,119,742 | A * | 9/2000 | Maeng | A63B 60/62 150/160 |
| 6,583,194 | B2 * | 6/2003 | Sendijarevic | C08G 18/4211 521/170 |
| 7,814,950 | B2 * | 10/2010 | Martin | A63B 57/00 150/155 |
| 8,061,522 | B2 * | 11/2011 | Eskenazi | B65D 25/101 206/591 |
| 8,225,830 | B2 * | 7/2012 | Maeng | A63B 60/62 150/160 |
| 2003/0096660 | A1 * | 5/2003 | Ward | A63B 57/60 473/299 |
| 2005/0079924 | A1 * | 4/2005 | Heinecke | A63B 53/14 473/300 |

(Continued)

*Primary Examiner* — Stephen Blau
(74) *Attorney, Agent, or Firm* — Boyle Fredrickson, S.C.

(57) ABSTRACT

An overgrip for a golf club is provided that includes a shell defining an interior and an open end, with a soft material disposed within the interior of the shell and capable of conforming to the shape of a club inserted into the interior through the at least one open end to engage the club. The shell can be formed with a pair of halves joined by a hinge to assist in the positioning of the club within the overgrip and can additionally include a locking mechanism to selectively hold the shell in engagement with the club positioned therein.

2 Claims, 2 Drawing Sheets

(56) References Cited

U.S. PATENT DOCUMENTS

| | | | | |
|---|---|---|---|---|
| 2007/0082749 | A1* | 4/2007 | Larson | A63B 55/10<br>473/300 |
| 2012/0090746 | A1* | 4/2012 | Barnett | A63B 57/00<br>150/160 |

* cited by examiner

GOLF CLUB OVERGRIP

CROSS-REFERENCE TO RELATED APPLICATIONS

This application claims priority from U.S. Provisional Patent Application Ser. No. 62/008,163, filed on Jun. 5, 2014, the entirety of which is hereby expressly incorporated by reference herein.

FIELD OF THE INVENTION

The present invention relates generally to golf clubs, and more specifically to grips for golf clubs.

BACKGROUND OF THE INVENTION

The game of golf is one of the most challenging sports not only to learn but also to play. One aspect of the game that often proves to be the most critical is putting. Many rounds are won or lost on the final putt. Hence the phrase, hit for show, putt for dough. Putting is not only most challenging for amateurs but also for pros alike. Putting under pressure for some is putting a three foot putt to win their $2 bet or for others winning the US Open.

Regardless of what is at stake, pressure can cause a golfer's putting stroke to change or break down missing even the easiest putt. Pressure can cause the golfer to change the path and direction of the putter head by moving their arms differently than normal or their wrist and hands might get more active causing the putter face to be "open" or "closed" at contact with the ball. Either way, this results in a missed putt.

One of the newest innovations in helping with these "putting woes" has been the oversize grip. The oversize grip design has proved to take the wrist out of the putting stroke thus eliminating one significant aspect to missing the putt. The oversize grip helps keep the hands "quiet" overall in all putting situations such that the wrists cannot break or bend, thereby maintaining the alignment of the hands and the arms of the golfer and making an overall more consistent and smoother stroke for the golfer.

However, for many golfers, what works for one doesn't necessarily work for another, or does not work all the time for the same person. The same holds true for the oversize putter grip. The oversize grip works for many but not for all, and can also work on some occasions but not in others for the same person for a variety of reasons. Often times a person is in the golf shop, they pick up a putter with an oversize grip and putt a few balls in the putting area or while out on the course they try a friends putter with an oversize grip. They like the feel and decide to put an oversize grip on their putter. They purchase the oversize grip, have it installed on their putter and after a few rounds find they really don't like it. They've spent $25 for the grip and now have to spend another $20 to purchase a new grip as close to their original as possible.

In an alternative scenario, a person has a putter they really like, sometimes an older classic putter and they want to try the new oversize grip to see if it will help improve their game. They take their prized putter to the golf shop, have the original grip removed and replaced with a new oversize grip. Now out on the course they discovered they don't like the feel and actually putt worse. They come to the conclusion it is not for them. However, at that point the original club has been modified, and they wish they had not devalued their putter by destroying the original grip while also having to endure the expense of replacing the oversize grip with one similar to what they had. In some instances, that putter will never be the same to them.

Thus, it is desirable to develop a grip for a golf club that can enable a person to change the grip on the golf club without damaging the underlying or original grip, thereby maintaining the integrity of the original club.

SUMMARY OF THE INVENTION

Briefly described, according to one aspect of an exemplary embodiment of the present disclosure, a golf club grip or overgrip is provided that is formed as a tubular member functioning as an oversize grip that can be releasably positioned over an existing grip on a golf club or other grip on a device without requiring the removal of or otherwise damaging the original grip. If the oversize grip improves the golfer's game, the individual can leave it on the club and continue to use it. If the individual does not like the feel or other attributes of the overgrip, the individual can disengage and remove the overgrip from the club, restoring the club to its original condition. This grip would also be a benefit to the individual if at a later date the club is sold, as the buyer has the option of grips to use i.e., the original grip or the overgrip. In the specific case of a classic or rare club or putter, the putter has not been devalued because the original grip remains intact. In each example, the original putter grip has been protected by the oversize grip/overgrip.

According to another aspect of another exemplary embodiment of the present disclosure, the overgrip is formed of a pair of separable portions that are hinged on one side and include interlocking connectors on the opposite side to hold the separable portions of the overgrip in a closed position on a club.

According to still another aspect of another exemplary embodiment of the disclosure, the grip portions or components can include a firm outer shell and a soft form fitting material inside the shell to conform to the shape of the existing grip to securely engage the grip. The outer shell of the portions or components of the overgrip can also optionally be covered with any suitable material, such as a soft material similar to the used on the interior of the components, to enhance the feel of the overgrip. The existing putter grip can also be covered with a sleeve separate from the overgrip to protect it from direct contact with the form fitting material on the interior of the shell and the overgrip can be used in all oversize grip sizes and can used on all putter grips regardless of grip shape or design.

Numerous other aspects, features, and advantages of the present invention will be made apparent from the following detailed description together with the drawings figures.

BRIEF DESCRIPTION OF THE DRAWINGS

The drawings illustrate the best mode currently contemplated of practicing the present invention.

In the drawings.

DETAILED DESCRIPTION OF THE INVENTION

Figure 1:
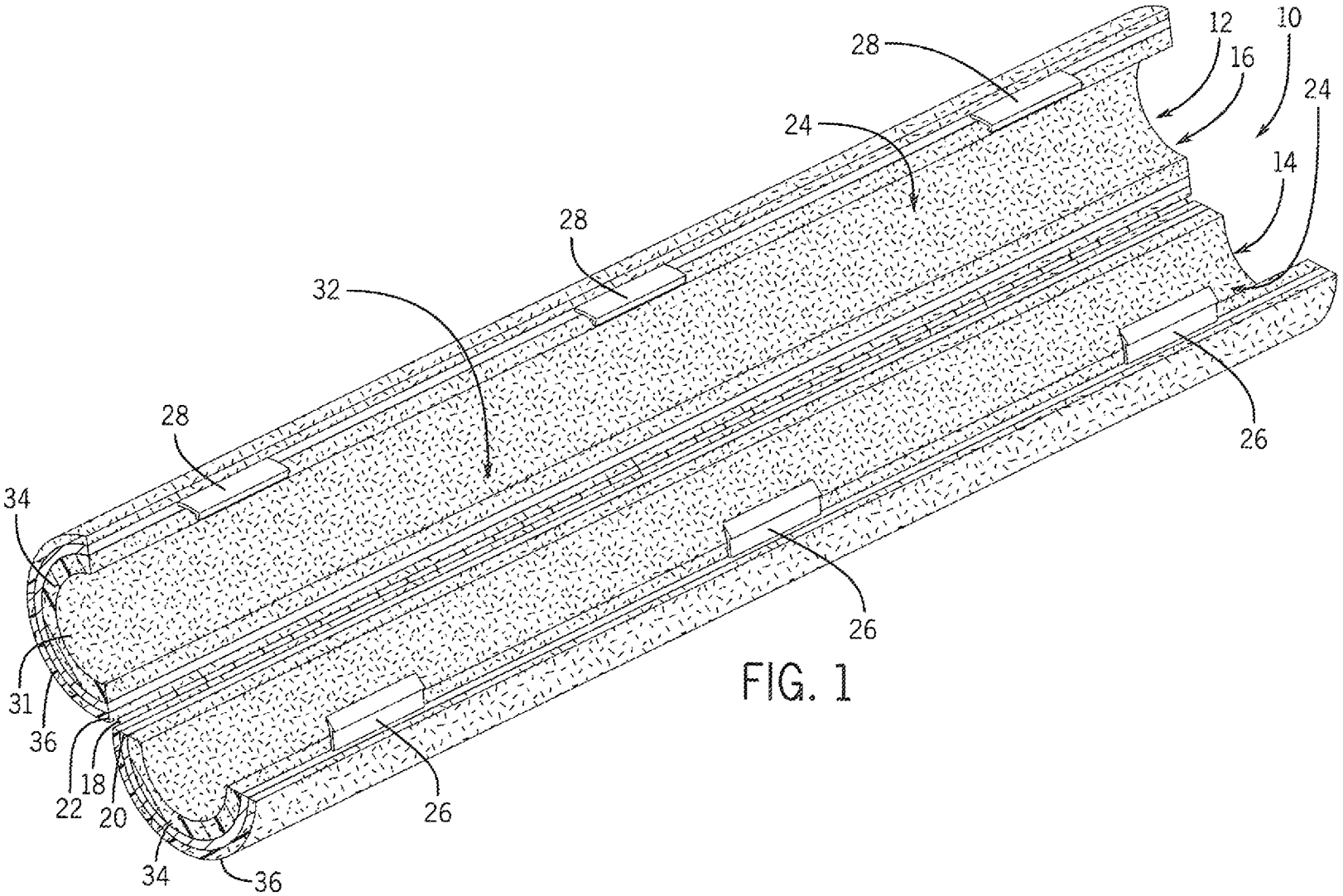
FIG. 1 is an isometric view of a one embodiment of a grip constructed according to the present disclosure.

Referring now in detail to the drawing figures, wherein like reference numerals represent like parts throughout the several views, one exemplary embodiment of an overgrip constricted according to the present disclosure is illustrated generally at 10 in FIG. 1. The overgrip 10 includes an outer shell 12 formed to be generally tubular in shape, e.g., cylindrical in cross-section though other cross-sectional configurations are also contemplated, and from a generally rigid material, such as a plastic material, that can be formed in any desired manner, such as by molding or extrusion into the desired shape. The outer shell 12 includes a pair of halves 14,16 that are joined to one another by a hinge 18 or similar structure disposed along and connecting adjacent ends or edges 20,22 of each half 14,16. The hinge 18 can be formed as a part of the halves 14,16 of the outer shell 12, i.e., as a living hinge from of the material forming each half 14,16, or as a separate component that is operably secured to each of the halves 14,16.

Figure 2:
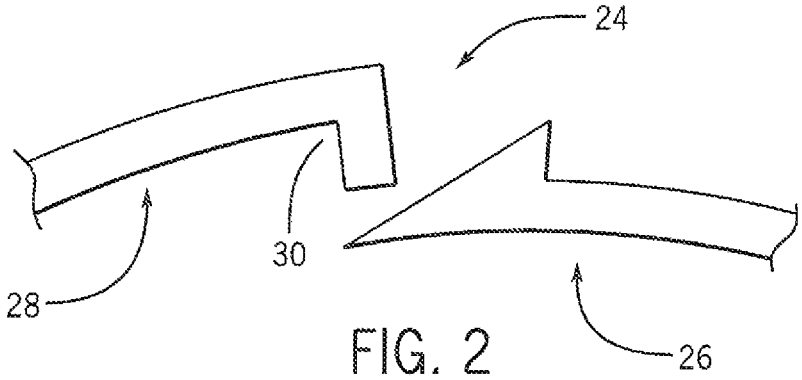
FIG. 2 is a partially broken away side plan view of the locking mechanism of the grip of FIG. 1.

Looking now at FIGS. 1 and 2, in the illustrated exemplary embodiment opposite the hinge 18, each half 14,16 includes one portion of a locking mechanism 24 disposed opposite the respective ends 20,22 to releasably hold the halves 14,16 in engagement with one another. The locking mechanism 24 can have any suitable form or structure, and in the illustrated embodiment is formed of a first set of hooks 26 disposed on one half 14 that are engagable with a set of latches 28 disposed in complementary positions on the opposite half 16. The hooks 26 and latches 28 can be attached to the halves 14,16 in any suitable manner, such as by adhesive or mechanical fasteners, or can be formed integrally with the respective halves 14,16.

To engage the locking mechanism 24, when the halves 14,16 of the outer shell 12 are moved towards one another, the hooks 26 are deflected inwardly by the latches 28 until the hooks 26 are aligned with recesses 30 defined on the latches 28 that can receive the hooks 26 to securely engage the hooks 26 with the latches 28. In the illustrated exemplary embodiment, in the engaged position, the locking mechanism 24 allows the opposite halves 14,16 of the shell 122 generally abut one another in the engaged position of the locking mechanism 24, thereby providing a generally seamless appearance to the overgrip 10 which also enhances the utility of the overgrip 10.

To disengage the locking mechanism 24, the half 14 of the outer shell 12 including the hooks 26 is pressed inwardly to misalign the hooks 26 from within the recesses 30, allowing the hooks 26 and the latches 28, and correspondingly the halves 14,16, to move apart from one another via the hinge 18.

Figure 4:
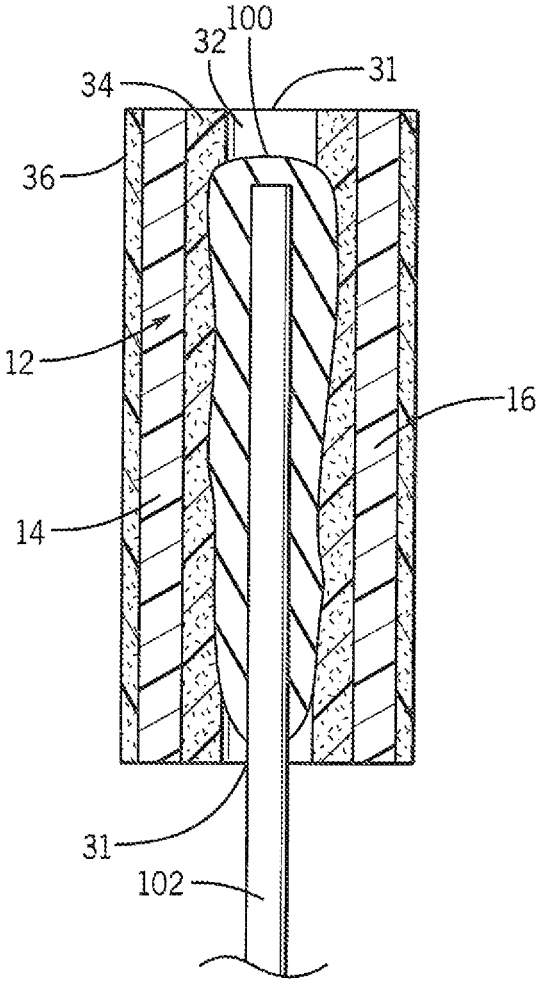
FIG. 4 is a cross-sectional view along line 4-4 of FIG. 3.

Looking now at FIGS. 1 and 4, in the illustrated exemplary embodiment the outer shell 12 defines a pair of open ends 31 and an interior 32 in which is disposed an inner soft, shape-conforming material layer 34 that secured to the inner surface of each half 14,16 of the outer shell 12 in any suitable manner, such as by an adhesive. The inner layer 34 can be formed from any suitable material, e.g., a gel, or open or closed cell foam material, among others, and is capable of conforming to the shape of any grip 100 for a club 102 that is positioned within the interior 32 of the overgrip 10. The material layer 34 is compressed by the grip 100 positioned within the interior 32 of the overgrip 10 against the inner layer 34 to provide a secure and close frictional engagement with the grip 100, thereby avoiding slippage between the inner layer 34 and the grip 100, but without damaging the grip 100. Also, the material forming the inner layer 34 is compressible but resilient such that when the grip 100 is removed from the interior 32 of the overgrip 10, the inner layer 34 can return to its original shape to be able to readily compressed to conform to the shape of any other alternate shape grip 100 to be placed within the interior 32 of the overgrip 10.

Figure 3:
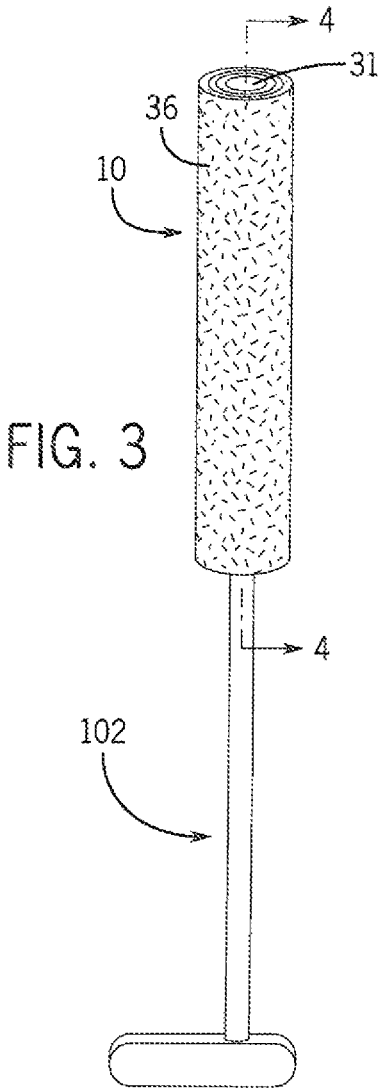
FIG. 3 is a front elevation view of the grip in a closed position on a club.

Referring now to FIGS. 1 and 3, in the illustrated exemplary embodiment opposite the inner layer 34 the outer shell 12 includes an outer grip layer 36. The outer grip layer 36 can be formed of any suitable material, such as those commonly used for conventional grips 100, among others, and is secured to the exterior surface of each half 14, 16 of the outer shell 12 opposite the inner layer 34 in any suitable manner, such as by an adhesive. The outer grip layer 36 provides the feel for the overgrip 10 to enhance the use of the club 102 including the overgrip 10.

In an alternative embodiment, the overgrip 10 can include a closed end (not shown) formed by panels (not shown) on the halves 14,16 of the shell 12 that are positioned in an abutting position on one end 31 of the overgrip 10 when the overgrip 10 is in the closed position. Further, the overgrip 10 can be formed without the hinge IS and either with two locking mechanisms 24 on each side of the respective halves 14,16, or with the shell 12 as a unitary structure such that the grip 100 is axially inserted and withdrawn from interior 32 of the overgrip 10. Additionally, in another alternative embodiment the locking mechanism 24 can be formed such that that the locking mechanism 24 requires a special tool or device (not shown) to disengage the locking mechanism 24, thereby preventing the overgrip 10 from being inadvertently removed from the grip 100, such as during play.

Various other embodiments of the present disclosure are contemplated as being within the scope of the filed claims particularly pointing out and distinctly claiming the subject matter regarded as the invention.

The invention claimed is:

1. A method of placing an overgrip on a golf club, the golf club having a shaft with a head at one end and a grip opposite the head, the method comprising the steps of:

a) providing an overgrip for a golf club comprising a shell defining an interior and at least one open end and an inner layer disposed within the interior of the shell and capable of conforming to the shape of a club inserted into the interior through the at least one open end to engage the club, wherein the inner layer is formed of a memory shape material that has a concave shape and provides a secure frictional engagement with the grip, thereby avoiding slippage between the inner layer and the grip but without damaging the grip;

b) inserting the grip into the at least one open end of the overgrip; and c) swinging the golf club while grasping the overgrip to strike a golf ball, wherein the overgrip shell includes a pair of opposed halves joined at a pair of opposed ends by a locking mechanism, and wherein the step of inserting the grip into the overgrip comprises the steps of:

i) disengaging the locking mechanism to separate the opposed halves;

ii) placing the grip within the interior of the between the opposed halves; and iii) re-engaging the locking mechanism to secure the opposed halves to one another.

2. The method of claim 1 further comprising the steps of:

a) disengaging the locking mechanism after re-engaging the locking mechanism; and b) removing the grip from the interior of the shell.

* * * * *